US010787178B2

(12) United States Patent
Tenet

(10) Patent No.: US 10,787,178 B2
(45) Date of Patent: Sep. 29, 2020

(54) PLATFORM SCREEN DOOR WITH BUILT-IN RAISED SILL

(71) Applicant: Faiveley Transport Tours, Saint-Pierre-des-Corps (FR)

(72) Inventor: Gilles Tenet, Suresnes (FR)

(73) Assignee: FAIVELEY TRANSPORT TOURS, Saint-Pierre-des-Corps (FR)

( * ) Notice: Subject to any disclaimer, the term of this patent is extended or adjusted under 35 U.S.C. 154(b) by 372 days.

(21) Appl. No.: 15/846,449

(22) Filed: Dec. 19, 2017

(65) Prior Publication Data

US 2018/0170401 A1 Jun. 21, 2018

(30) Foreign Application Priority Data

Dec. 19, 2016 (FR) ..... 16 62770

(51) Int. Cl.
*B61B 1/02* (2006.01)
*E06B 3/46* (2006.01)
*E06B 1/70* (2006.01)

(52) U.S. Cl.
CPC ..... *B61B 1/02* (2013.01); *E06B 1/70* (2013.01); *E06B 3/4636* (2013.01)

(58) Field of Classification Search
CPC ..... B61B 1/02; B61B 1/00; E06B 1/70; E06B 3/4636
See application file for complete search history.

(56) References Cited

U.S. PATENT DOCUMENTS 5,444,885 A * 8/1995 Hanrahan ..... B61B 1/02 105/425
5,669,307 A * 9/1997 Cichy ..... B61B 1/02 104/28
2002/0194787 A1* 12/2002 Bennett ..... E06B 1/70 49/467

(Continued)

FOREIGN PATENT DOCUMENTS

EP 0 223 007 5/1987
FR 3 002 780 9/2014

(Continued)

OTHER PUBLICATIONS

Search Report dated Aug. 25 27 (two pages) from French priority Application No. FR 1662770.

*Primary Examiner* — Justin M Jonaitis
(74) *Attorney, Agent, or Firm* — Christopher R. Carroll; The Small Patent Law Group LLC

(57) ABSTRACT

A screen door module for a platform edge of a vehicle station. The module includes a leaf that moves between open and closed positions, a fixed element to which the leaf is mechanically connected and along which it slides and a sill extending under the leaf and under the fixed element. The module also includes a raiser with a predetermined height extending under the leaf and the fixed element and being arranged in such a way as to be laid on a finished ground level of the platform and so the predetermined height corresponds to a difference between the finished ground level and the floor of the vehicle when the latter comes to a standstill alongside the module. An access ramp on the platform side runs along the entire length of the module and allows access to passengers of limited mobility.

9 Claims, 3 Drawing Sheets

(56) References Cited

U.S. PATENT DOCUMENTS

| | | | | |
|---|---|---|---|---|
| 2010/0064590 | A1* | 3/2010 | Jones | E05D 15/0656 49/469 |
| 2015/0013232 | A1* | 1/2015 | Rager-Frey | E06B 1/70 49/469 |
| 2017/0016268 | A1* | 1/2017 | Reyes | E06B 1/70 |
| 2017/0183896 | A1* | 6/2017 | Dastrup | E05D 15/0686 |

FOREIGN PATENT DOCUMENTS

| | | | | |
|---|---|---|---|---|
| GB | 2 418 221 | | 3/2006 | |
| GB | 2418221 | A * | 3/2006 | E05D 15/14 |
| JP | 2002104175 | | 4/2002 | |
| JP | 2016 014265 | | 1/2016 | |

* cited by examiner

PLATFORM SCREEN DOOR WITH BUILT-IN RAISED SILL

This application claims priority to French patent application No. 1662770 filed on Dec. 19, 2016, the entire contents of which are incorporated herein by reference.

BACKGROUND

The invention relates to a station platform edge screen door module comprising a built-in sill. The invention also relates to a station platform edge screen comprising such a screen door module.

At the present time, the creation of a station platform edge screen requires setting into the finished platform ground level the elements that secure or drive the screen door module or modules that make up the screen. That means that it is necessary to perform extensive and expensive preparation work on the platform that is to be so equipped, this work consisting in making an excavation to the dimensions of the base or of the drive system in the station platform edge. For example, such a screen is described in document FR3002780. In addition, this preparation becomes all the more extensive when, in addition, the finished ground level of the platform must be raised to be at a same level as the floor of a transport vehicle, for example a passenger transport vehicle, intended to come to a standstill alongside the platform being so equipped.

SUMMARY

It is an object of the invention to provide a screen door module which does not require any preparation of the ground level of the platform, except for possible additional rework to the platform in order to react the load transmitted by the module to the ground, while at the same time making it possible to make up the deficit to the floor level of the vehicle, without impeding actual access itself to the vehicle.

To this end, the invention provides a screen door module for a platform edge of a station through which there passes a transport vehicle comprising a floor, the module comprising:

at least one leaf able to move between respectively open and closed positions;

at least one fixed element to which the leaf is mechanically connected and along which the leaf slides between the open and closed positions;

a sill extending under the leaf and under the fixed element, the sill comprising:

a raiser having a predetermined height, the raiser extending under the leaf and the fixed element and being arranged in such a way that, when the module is mounted on the station platform edge, it is laid on a finished ground level of the platform and in such a way that the predetermined height corresponds to a difference, that is partially or completely filled, between the finished ground level and the floor of the transport vehicle when the latter comes to a standstill alongside the module; and an access ramp, on the platform side, running along the entire length of the screen door module, notably allowing access for passengers of reduced mobility.

Thus, such a structure for the screen door module allows the latter to be simply placed on and fixed to the unmodified ground level of the platform edge without any special preparation of the latter, except for any possible rework required in order to react the load transmitted by the screen door module to the ground. In addition, the choice of the predetermined height of the sill raiser provides a simple way for making up the deficit to the floor level of the vehicle. Finally, the presence of the access ramp makes it easier for passengers, particularly those of reduced mobility, to board and to alight.

Advantageously, although optionally, the screen door module according to the invention has at least one of the following additional technical features:

the raiser comprises a technical compartment extending longitudinally over a length of the raiser;

the sill comprises a floor closing the compartment at the level of an opening created when the leaf is in the open position;

the module further comprises an emergency door and/or a fixed panel extending substantially in the continuation of the fixed element, the sill extending also under the emergency door and/or the fixed panel;

the raiser and the ramp are made as one piece with one another in the same material;

the ramp is made from insulating materials;

the ramp is made from electrically conducting materials; and the module comprises visual passenger signaling and/or means of guiding the visually impaired.

The invention also provides a station platform edge screen designed to extend all along the platform, and comprising at least one screen door module having at least one of the foregoing technical features.

Advantageously, although optionally, the station platform edge screen according to the invention has at least one of the following additional technical features:

the sill extends along the entire length of the screen.

Further features and advantages of the invention will become apparent during the course of the following description of one embodiment of the invention. In the attached drawings:

DETAILED DESCRIPTION

Figure 3:
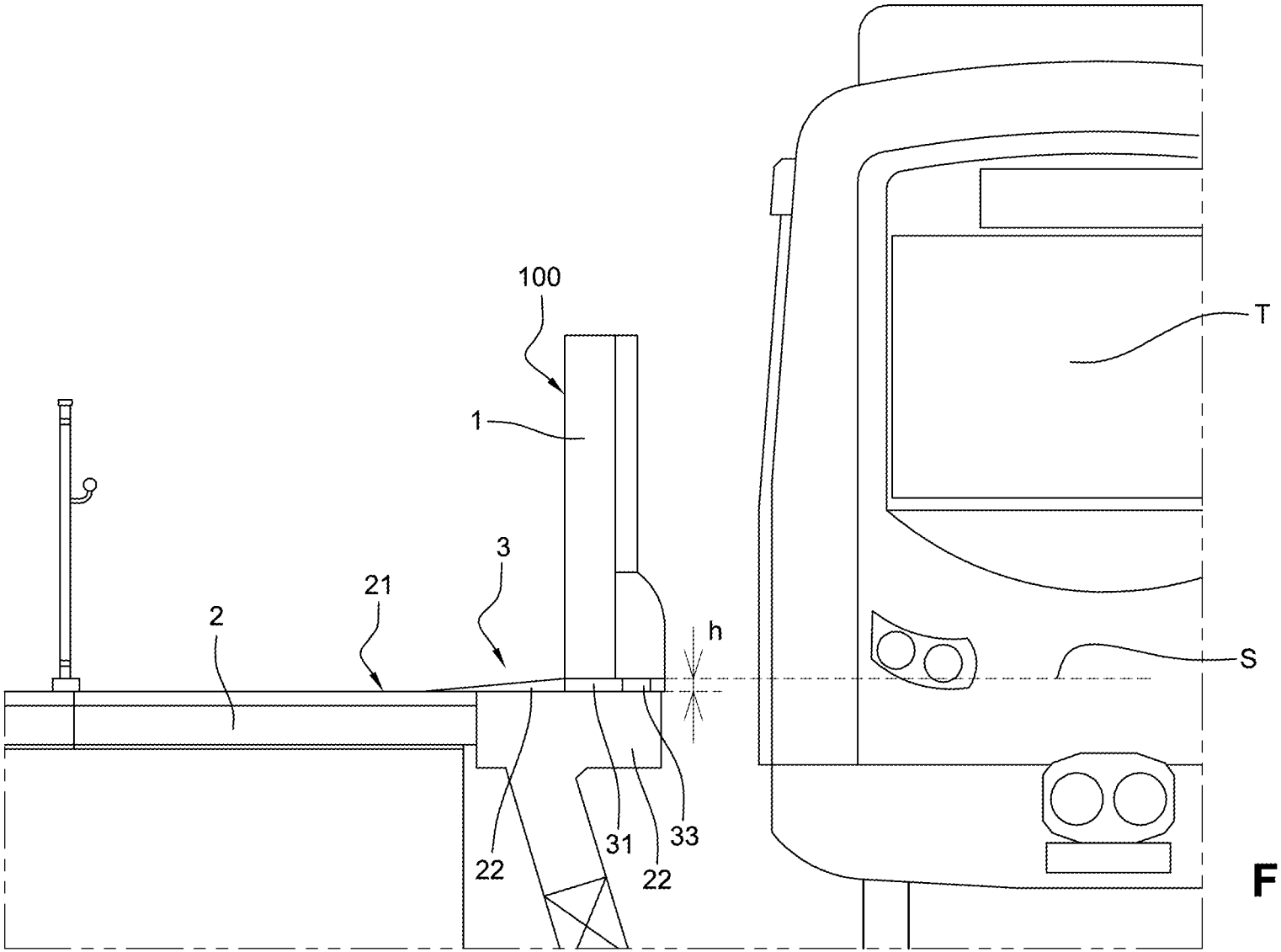
FIG. 3 is a partial side view of an installation in a situation in which a screen according to the invention comprising the module of FIG. 1 has a transport vehicle at a standstill alongside the platform.

One embodiment of a station platform screen 100 according to the invention will be described in a situation with reference to FIG. 3. The station platform edge screen 100 according to the invention comprises at least one screen door module 1 according to the invention and will be described in greater detail later. The screen door module 1 according to the invention comprises a built-in sill 3. The screen door module 1 is placed on a station platform 2 edge 22 on the finished ground level 21. FIG. 3 depicts a transport vehicle T at a standstill alongside the platform 22. This transport vehicle T comprises a floor S which, once the vehicle is stationary alongside the platform 2, is at a height h above the finished ground level 21 of the station platform 2. The screen door module 1 according to the invention is designed in such a way as to make up the deficit in height between the finished ground level 21 of the station platform 2 and the floor S of the transport vehicle T, while making access to the latter from the platform easier.

Figure 1:
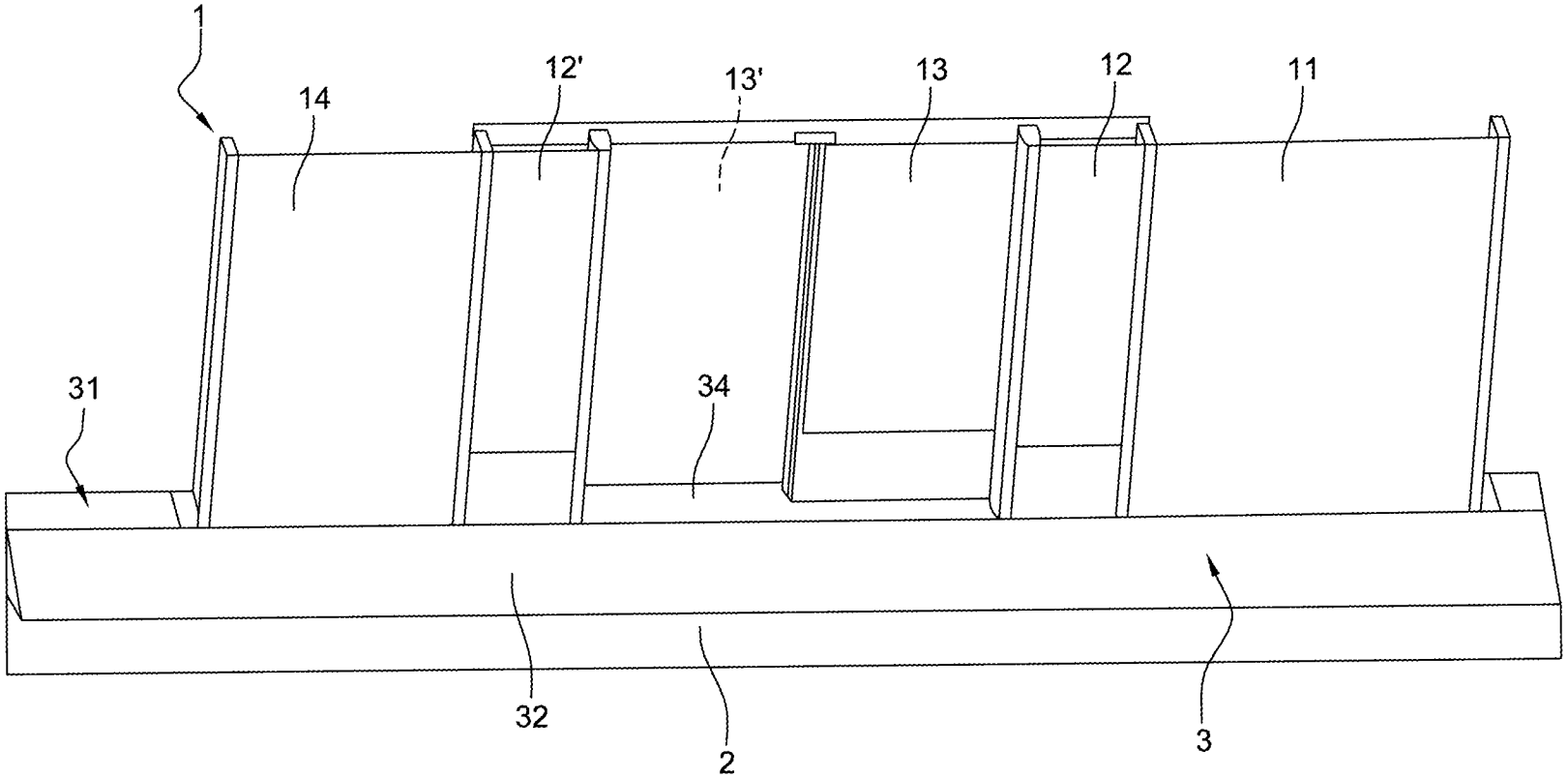
FIG. 1 is a three-dimensional view of one embodiment of a screen door module according to the invention, placed on an existing platform edge.
Figure 2:
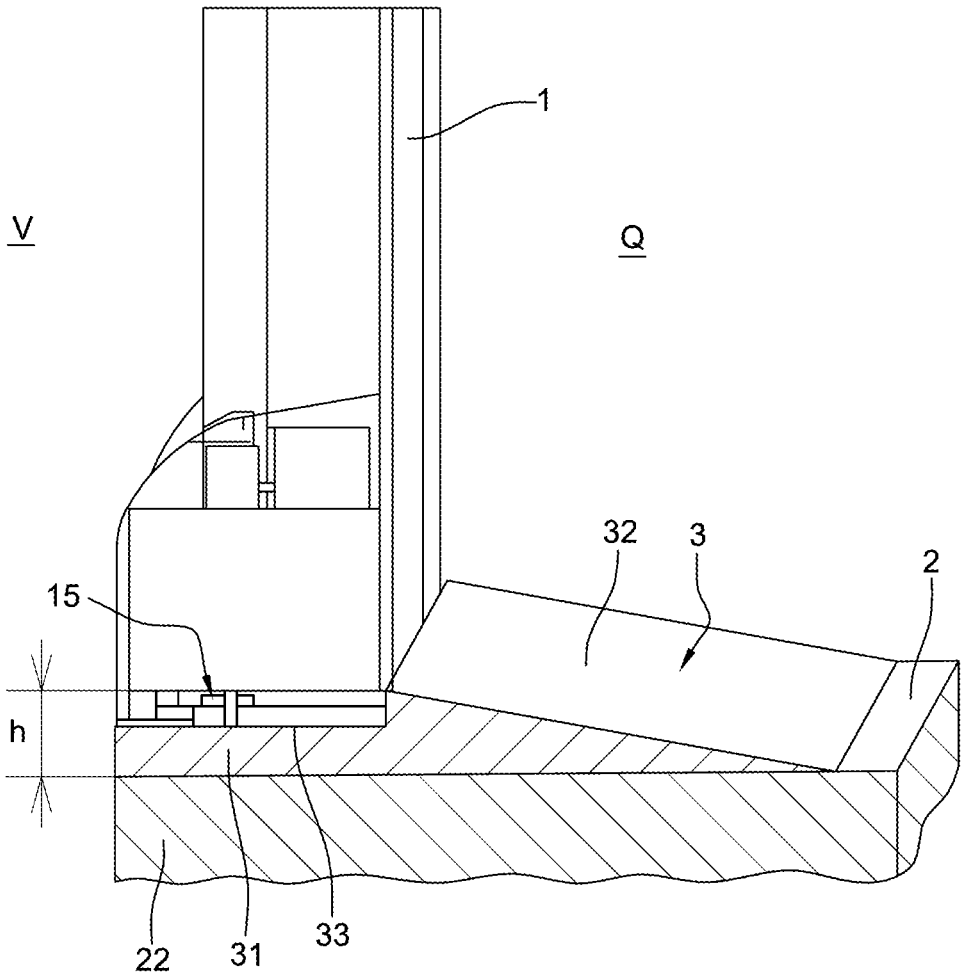
FIG. 2 is a partial view in cross section of a detail of the placed module of FIG. 1.

One embodiment of the screen door module 1 according to the invention will be described in greater detail with reference to FIGS. 1 and 2. In a way known per se, the screen door module 1 according to the invention comprises at least a first leaf 13 able to move between a closed position and an open position. Here, illustrated in FIG. 1, the screen door module comprises first 13 and second 13' leaves of this type of which just one 13 is depicted in the closed position. Furthermore, the screen door module 1 according to the invention comprises at least one first fixed element 12 to which the leaf 13 is mechanically connected and along which it slides in parallel between the opened and closed positions. First 12 and second 12' fixed elements of this type respectively associated with the first 13 and second 13' leaves are illustrated here. What is meant by a fixed element 12 or 12' is a fixed unit, as illustrated in FIG. 1, extending substantially in a plane, or between two uprights supporting an upper beam in which is housed a system for driving the leaves 13,13'. Optionally, the screen door module 1 according to the invention comprises at least one emergency door 14 adjacent to the fixed element 12' and extending slightly in the continuation of the said fixed element 12'. The emergency door 14 is positioned on an opposite side of the fixed element to the side on which the leaf 13 extends in the closed position. Furthermore, here, in the continuation of the second fixed element 12, the screen door module 1 according to the invention comprises a fixed panel 11, adjacent to the said fixed unit. In an alternative form of embodiment, the fixed panel 11 is replaced by a second emergency door 14 or, alternatively, the emergency door 14 is replaced by a second fixed panel 11. In place on the station platform 2 edge 22, the screen door module 1 according to the invention (and, therefore, the station platform edge screen 100 according to the invention) separates a platform side Q from a track side V.

The screen door module 1 according to the invention further comprises a sill 3 extending at least under all of the aforementioned elements of the screen door module, namely: under the at least first leaf 13 and the at least first fixed unit 12. In the exemplary embodiment of the screen door module 1 according to the invention illustrated in FIGS. 1 and 2, the sill 3 extends at least under, from left to right in FIG. 1, the emergency door 14, the second fixed element 12', the second leaf 13', the first leaf 13, the first fixed element 12 and the fixed panel 11. The sill 3 here comprises two parts made up of a raiser 31 and of an access ramp 32.

The raiser 31 has a predetermined height h which here corresponds to the difference in height between the finished ground level 21 of the platform 2 and the floor S of the transport vehicle T intended to come to a standstill alongside the platform 2 thus equipped with the screen door module 1 according to the invention. The raiser 31 extends under all of the other elements that make up the screen door module 1 according to the invention which are the leaves 13 and 13', the fixed units 12 and 12', the emergency door 14 and/or the fixed panel 11. According to one embodiment, the raiser 31 further comprises a technical compartment 33 which extends longitudinally over a length of the raiser 31. This technical compartment 33 may house a drive system 15 for the leaves 13, 13' of the screen door module 1 according to the invention, and/or the wiring needed for operation of the said module. Optionally, the screen door module 1 according to the invention is equipped with visual signaling reserved for passengers, which may be static or dynamic or both, the technical compartment 33 being used to run the elements needed for powering and operating the installed signaling.

In order to protect the contents of the technical compartment 33, the raiser comprises a floor 34 allowing the technical compartment 33 to be closed, at least at the level of an opening created when the leaf or leaves 13, 13' are in the open position, or when the emergency door is in the open position.

The access ramp 32 is positioned laterally with respect to the raiser 31 to extend laterally from the raiser 31 on the platform side Q. The access ramp 32 extends all along the raiser 31, therefore all along the screen door module 1 according to the invention. The access ramp 32 thus positioned makes it possible, on the platform side Q, to eliminate a step of height h between the finished ground level 21 of the station platform 2 and the top of the raiser 31 once the screen door module 1 according to the invention has been laid on the finished ground level 21. A width and, therefore, inclination, is chosen to allow individuals of reduced mobility to pass from the finished ground level 21 of the station platform 2 to the level of the floor S of a transport vehicle at a standstill alongside the screen door module 1 according to the invention. In one embodiment, the access ramp 32 and, possibly, the raiser 31, is made from electrically insulating materials. As an alternative form of embodiment, the access ramp 32, and possibly the raiser 31, is made from electrically conducting materials, allowing any electrical equipment in the screen door module 1 according to the invention to be earthed in a simple way. In an alternative form of embodiment, the access ramp 32 is equipped with means for guiding the visually impaired, such as guide strips.

In addition, the access ramp 32 and the raiser 31 are formed as one piece with one another from the same material.

Furthermore, the arrangement of the sill 3 as has just been described in the foregoing paragraphs offers the advantage of allowing better distribution of the mechanical load generated when the screen door module 1 according to the invention is used in operation: specifically, this load is thus distributed over the entirety of a bearing surface via which the sill 3 rests on the finished ground level 21 of the station platform at the platform edge 22.

This is in addition to the fact that the screen door module 1 according to the invention is simply placed on and fixed to the finished ground level 21 during installation, avoiding platform edge 22 preparation which, because of the excavation, would weaken it.

The screen 100 according to the invention comprises one or several screen door modules 1 according to the invention depending on the configuration of the platform 2 that is to be equipped and of the transport vehicles T intended to come to a standstill alongside this screen 100. Whatever the configuration of the screen door modules 1 according to the invention that make up the screen 100, the sills 3 of the screen door modules 1 according to the invention are arranged in such a way that a continuous sill extends along the entire length of the screen 100.

Of course, it is possible to modify the invention in numerous ways without departing from the scope thereof.

The invention claimed is:

1. A screen door module for a platform edge of a station through which a vehicle having a floor passes, the module comprising:

a leaf configured to move between an open and a closed position;

a fixed element to which the leaf is mechanically connected and along which the leaf slides between the open and closed position;

a sill extending under the leaf and under the fixed element, wherein the sill comprises:

a raiser having a predetermined height and extending under the leaf and the fixed element and being arranged so that, when the module is mounted on the station platform edge, the module is laid on a finished ground level of the platform and in a manner that the predetermined height corresponds to a height difference between the finished ground level and the floor of the vehicle when the vehicle is at a standstill alongside the module, wherein the height difference being partially or completely filled by the raiser; and an access ramp, on a platform side, running along an entire length of the screen door module to allow access for passengers of reduced mobility.

2. The screen door module according to claim 1, wherein the raiser comprises a technical compartment extending longitudinally over a length of the raiser.

3. The screen door module according to claim 2, wherein the sill comprises a floor closing the compartment at a level of an opening created when the leaf is in the open position.

4. The screen door module according to claim 1 further comprising an emergency door and/or a fixed panel extending substantially in a continuation of the fixed element, the sill extending under the emergency door and/or the fixed panel.

5. The screen door module according to claim 1, wherein the raiser and the access ramp are one piece.

6. The screen door module according to claim 1, wherein the access ramp is made from insulating materials.

7. The screen door module according to claim 1, wherein the access ramp is made from electrically conducting materials.

8. A station platform system, comprising:

a platform of a station, wherein the platform comprises a station platform edge in which a vehicle may come to a standstill alongside;

an edge screen configured to extend along the platform, wherein the edge screen comprises a screen door module comprising:

a leaf configured to move between an open and a closed position;

a fixed element to which the leaf is mechanically connected and along which the leaf slides between the open and closed position;

a sill extending under the leaf and under the fixed element, wherein the sill comprises:

a raiser having a predetermined height and extending under the leaf and the fixed element and being arranged so that, when the module is mounted on the station platform edge, the module is laid on a finished ground level of the platform and in a manner that the predetermined height corresponds to a height difference between the finished ground level and the floor of the vehicle when the vehicle is at a standstill alongside the module, wherein the height difference being partially or completely filled by the raiser; and an access ramp, on a platform side, running along an entire length of the screen door module to allow access for passengers of reduced mobility.

9. The station platform system according to claim 8, wherein the sill extends along an entire length of the edge screen.

* * * * *